US007380526B2

(12) United States Patent
Fattorusso

(10) Patent No.: US 7,380,526 B2
(45) Date of Patent: Jun. 3, 2008

(54) POWER TOOL

(75) Inventor: Antonio Fattorusso, Leinfelden-Echterdingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 11/616,921

(22) Filed: Dec. 28, 2006

(65) Prior Publication Data

US 2007/0157913 A1 Jul. 12, 2007

(30) Foreign Application Priority Data

Jan. 12, 2006 (DE) ..... 10 2006 001 570

(51) Int. Cl.
*F02B 33/04* (2006.01)
*F02B 25/00* (2006.01)

(52) U.S. Cl. ..... 123/73 PP; 123/73 A

(58) Field of Classification Search ..... 123/73 PP, 123/73 A, 73 AA, 74 R, 74 A, 65 A, 65 SP
See application file for complete search history.

(56) References Cited

U.S. PATENT DOCUMENTS 1,149,178 A 8/1915 Brice
6,112,708 A 9/2000 Sawada et al.
7,096,834 B2 * 8/2006 Yuasa et al. ..... 123/73 PP
2007/0157914 A1 * 7/2007 Fattorusso ..... 123/73 PP

FOREIGN PATENT DOCUMENTS

| | | |
|---|---|---|
| DE | 1 025 207 | 2/1958 |
| DE | 160849 | 12/2006 |
| EP | 1207291 | 5/2002 |
| JP | 2001-355451 | 12/2001 |

* cited by examiner

*Primary Examiner*—Stephen K. Cronin
*Assistant Examiner*—Hyder Ali
(74) *Attorney, Agent, or Firm*—Gudrun E. Huckett

(57) ABSTRACT

A power tool has a working tool that is driven by a two-stroke engine that has a cylinder and a piston reciprocating within the cylinder and delimiting a combustion chamber in the cylinder. The two-stroke engine has a crankcase with a rotatably supported crankshaft that is driven by the piston with a connecting rod. Transfer passages connect the crankcase to the combustion chamber in at least one position of the piston. A mixture passage intake supplies a fuel/air mixture, and an air passage supplies combustion air. The combustion chamber has an exhaust port. The two-stroke engine has a transverse plane dividing the cylinder in a direction of the longitudinal cylinder axis. The exhaust port is arranged on one side of the transverse plane, and air passage and mixture passage are arranged on opposite sides of the transverse plane.

15 Claims, 4 Drawing Sheets

POWER TOOL

BACKGROUND OF THE INVENTION

The invention relates to a power tool comprising a working tool that is driven by a two-stroke engine. The two-stroke engine comprises a cylinder having a combustion chamber arranged therein. The combustion chamber is delimited by a piston, wherein the piston is movable in the direction of a longitudinal cylinder axis within the cylinder and drives by means of a connecting rod a crankshaft that is rotatably supported about an axis of rotation in the crankcase. In at least one position of the piston, the crankcase is in flow communication with the combustion chamber by means of at least one transfer passage. The transfer passage opens with a transfer port into the combustion chamber. A mixture passage is provided for supplying a fuel/air mixture. The mixture passage has a piston-controlled mixture intake provided at the cylinder. An air passage for supplying combustion air is provided. An exhaust port is connected to the combustion chamber. The two-stroke engine has a transverse plane that divides the cylinder in the direction of the longitudinal cylinder axis. On one side of the transverse plane the exhaust port of the combustion chamber is arranged.

U.S. Pat. No. 6,112,708 discloses a two-stroke engine for a power tool, for example, a motor chainsaw. The two-stroke engine is operated with scavenging air. For this purpose, the two-stroke engine has a mixture passage for supplying a fuel/air mixture into the crankcase of the two-stroke engine and an air passage that supplies the transfer passages with scavenging air. The mixture passage and the air passage are arranged at the cylinder side that is opposite the exhaust port. The mixture passage extends on the side of the air passage that is facing the crankcase. Since both passages are arranged above one another, the two-stroke engine requires a lot of space on the side opposite the exhaust port.

SUMMARY OF THE INVENTION

It is an object of the present invention to provide a power tool of the aforementioned kind that is of a compact configuration.

In accordance with the present invention, this is achieved in that the air passage and the mixture passage are located on opposite sides of the transverse plane. On one side of the transverse plane, the exhaust port is arranged. In this way, one of the passages is arranged on the side of the transverse plane where the exhaust port is arranged. By arranging the passages on opposite sides of the transverse plane, the passages can be positioned close to the cylinder so that a compact overall configuration of the power tool results.

It is provided that the axis of rotation of the crankshaft extends perpendicularly to the transverse plane. In this way, the two ends of the crankshaft exit from the crankcase on opposite sides of the transverse plane. In this way, an advantageous arrangement of the exhaust port is achieved. In particular when the power tool is a motor chainsaw with an top handle in which the two-stroke engine is lying (is substantially horizontally arranged) in the power tool housing, it is possible, by providing the axis of rotation of the crankshaft perpendicularly to the transverse plane, for the exhaust gases to exit laterally from the power tool and not from the bottom side of the power tool that is facing the ground. Advantageously, the mixture passage is arranged on the side of the transverse plane where the exhaust port of the combustion chamber is arranged. In this way, the mixture intake and the exhaust port are arranged on the same side of the cylinder. In particular in the case of two-stroke engines in which the air intake opens at the cylinder and is controlled by the piston, a minimal size of the two-stroke engine can be realized in this way. This is so because the piston recess connecting the air intake with a transfer passage can be configured to be of a sufficiently large size even for a minimal piston height. By arranging the mixture intake at the side of the transverse plane where the exhaust port is arranged, the size of the two-stroke engine can be reduced. Advantageously, the piston-controlled mixture intake opens into the crankcase adjacent to the exhaust port at the side of the exhaust port that is facing the crankcase. Expediently, the two-stroke engine has a center plane that divides the exhaust port of the combustion chamber wherein on each side of the center plane at least one transfer passage is arranged. In particular, the center plane divides the exhaust port of the combustion chamber centrally so that a symmetric arrangement results. The main flow direction in the exhaust port is in particular parallel to the center plane. The center plane is advantageously perpendicular to the transverse plane; the longitudinal cylinder axis and the axis of rotation of the crankshaft are located within the transverse plane.

Advantageously, in at least one position of the piston the air passage is connected by means of at least one piston recess to at least one transfer port of a transfer passage. The connection between air passage and transfer passage is thus piston-controlled. Advantageously, the air passage is divided upstream of the air intake into two branches and the piston has two piston recesses that are arranged on opposite sides of the center plane; each branch of the air passage opens in the area of a piston recess into the cylinder. Since the mixture intake opens at the side of the transverse plane opposite the air passage, it can also be provided that the piston has a single piston recess that is connected in at least one piston position with the transfer ports of all transfer passages and that the air passage opens by means of a single air intake into the cylinder. The air intake opens, viewed in the circumferential direction of the piston, into a central area of the piston recess. A division of the air passage into two branches is thus not necessary so that a simplified passage arrangement is realized. Since the piston controls on the side of the transverse plane opposite the exhaust port only the connection between the air passage and the transfer ports, a single piston recess can be provided. The piston recess can be comparatively large so that a minimal flow resistance results in the piston recess and the transfer ports can be filled well. In this way, the height of the piston recess, i.e., the extension of the piston recess parallel to the longitudinal cylinder axis, can be reduced so that the piston as a whole has a reduced height. In this way, a reduced size of the two-stroke engine results.

It is provided that the two-stroke engine has a carburetor in which a mixture passage section is provided and in which a throttle element is pivotably guided wherein the two-stroke engine has an air passage component in which an air passage section is provided and in which a choke is pivotably supported. The air passage component is advantageously secured on the carburetor. Advantageously, the carburetor and the air passage component are arranged at the level of the cylinder head of the cylinder.

The power tool has advantageously a power tool housing and an top handle that extends across the top side of the housing. Since the air passage and the mixture passage extend on opposite sides of the transverse plane, a minimal size of the two-stroke engine results that enables easy handling of the power tool. Advantageously, the carburetor is arranged on the side of the cylinder facing the top handle, i.e., above the cylinder. The two-stroke engine is advantageously arranged not in an upright position within the power tool but is lying in the power tool, i.e., is essentially horizontally arranged. The two-stroke engine is arranged in the power tool housing in particular in such a way that the transverse plane of the two-stroke engine extends approximately parallel to the longitudinal direction of the top handle.

DESCRIPTION OF THE PREFERRED EMBODIMENTS

Figure 1:
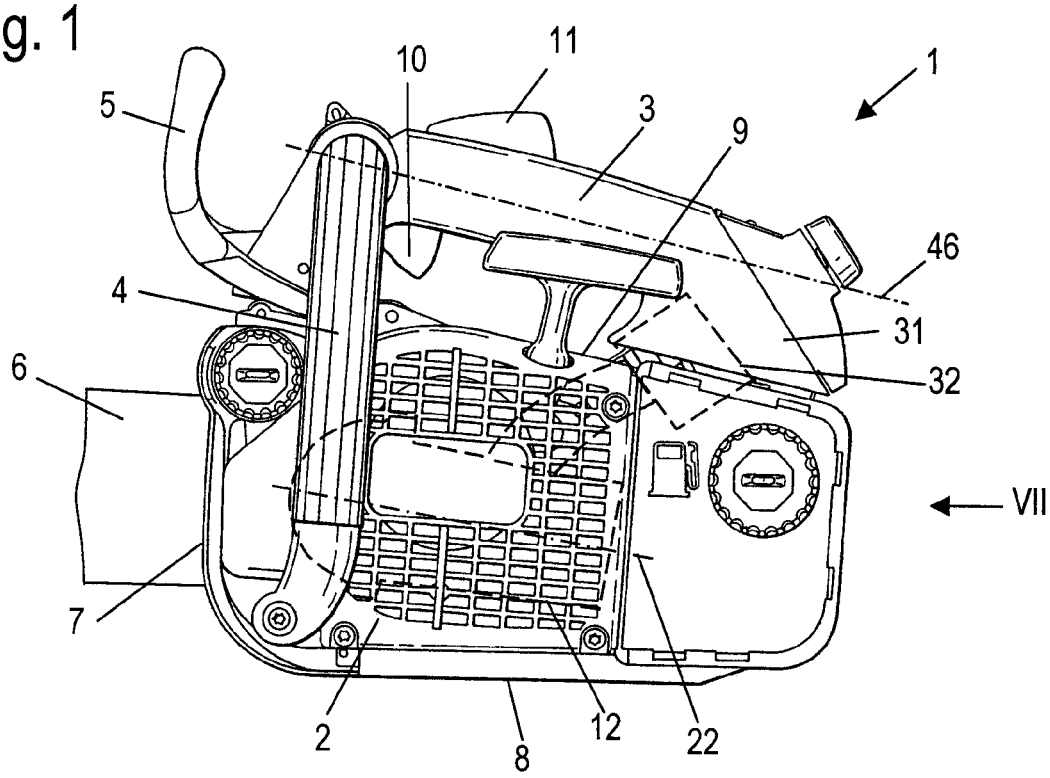
FIG. 1 is a schematic side view of a power tool according to the invention.

The power tool illustrated in FIG. 1 is a motor chainsaw 1 that is configured as a top handle chainsaw. The motor chainsaw 1 has a power tool housing 2 in which the two-stroke engine 12 that is schematically shown in FIG. 1 is arranged. The power tool housing 2 has a bottom side 8 for resting the motor chainsaw 1 thereon. The two-stroke engine 12 is lying (i.e., is arranged essentially horizontally) in the power tool housing 2 adjacent to the bottom side 8 of the power tool housing 2. On the top side 9 of the power tool housing 2 opposite the bottom side 8, a top handle 3 is provided. The longitudinal axis 46 of the top handle 3 extends approximately parallel to the longitudinal cylinder axis 22 of the two-stroke engine 12. The top handle 3 has a grip housing 31 in which at least one section of a carburetor 32 of the two-stroke engine 12 is arranged. It is also possible to arrange the carburetor 32 completely within the grip housing 31. The two-stroke engine 12 drives a saw chain, not illustrated in FIG. 1, of the motor chainsaw 1; this saw chain circulates about the guidebar 6 that extends, starting at the front end 7 of the power tool housing 2 of the motor chainsaw 1, approximately parallel to the longitudinal axis 46 of the top handle 3. Adjacent to the front end 7 a grip pipe 4 is arranged so as to extend from the end of the top handle 3 facing the front end 7 to an area of the power tool housing 2 of the motor chainsaw 1 that is adjacent to the bottom side 8. In the area of the front end 7 a hand guard 5 is mounted on the power tool housing 2 adjacent to the grip pipe 4 and the top handle 3. A throttle lever 10 and a throttle lever lock 11 for operating the two-stroke engine 12 are arranged on the top handle 3. The carburetor 32 is arranged in the grip housing 31 at the end of the top handle 3 facing away from the front end 7.

Figure 2:
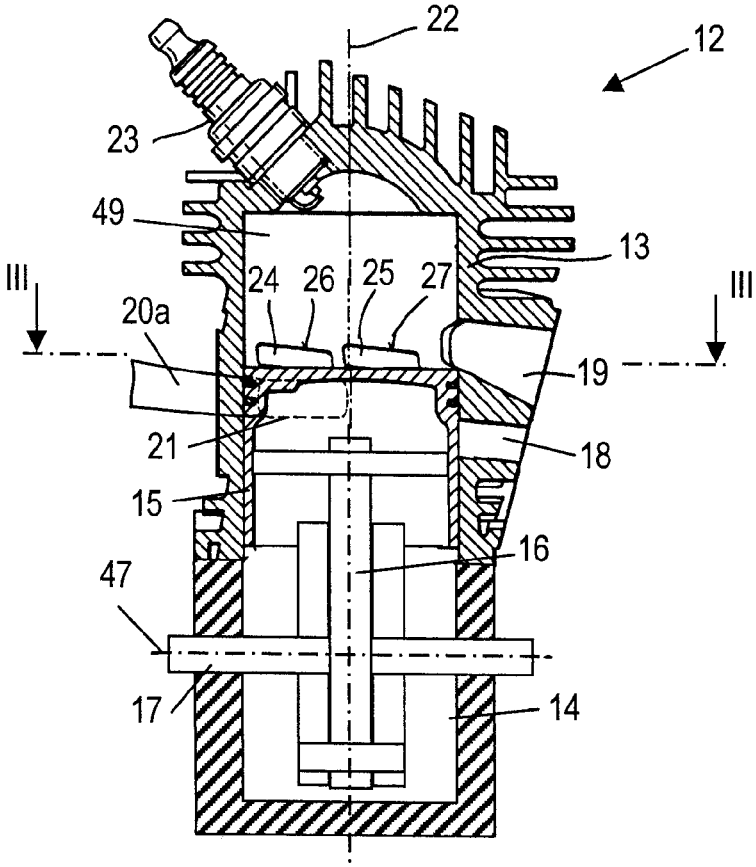
FIG. 2 is a schematic longitudinal section view of the two-stroke engine of the power tool according to FIG. 1.
Figure 3:
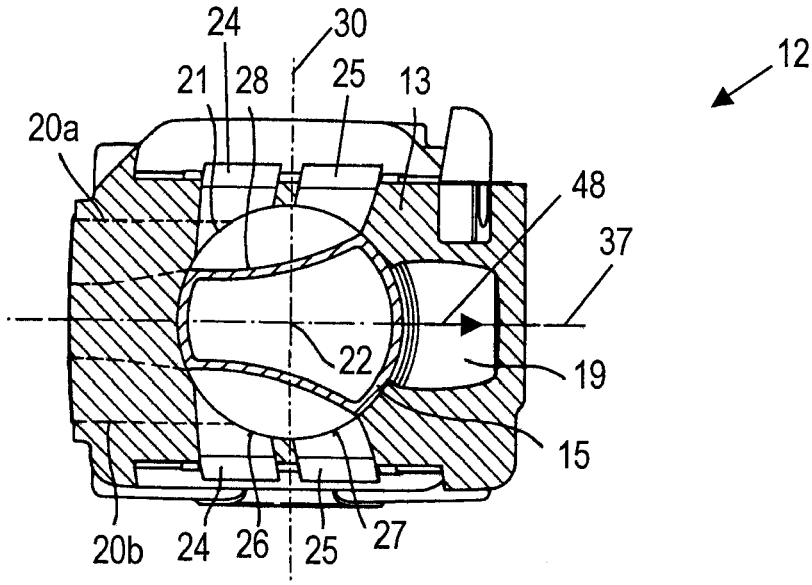
FIG. 3 is a section view along the section line III-III of FIG. 2 showing the piston at top dead center.

In FIGS. 2 and 3, the two-stroke engine 12 is schematically illustrated. The two-stroke engine 12 has a cylinder 13 in which a piston 15 is reciprocatingly supported in the direction of the longitudinal cylinder axis 22. The piston 15 delimits a combustion chamber 49 provided in the cylinder 13. An exhaust port 19 leads away from the combustion chamber 49. A spark plug 23 projects into the combustion chamber 49. The piston 15 drives by means of a connecting rod 16 a crankshaft 17 that is rotatably supported in the crankcase 14. The crankshaft 17 is rotatably supported about axis of rotation 47. The two-stroke engine 12 has a mixture intake 18 that opens directly below the exhaust port 19 into the cylinder 13 on the side of the exhaust port 19 facing the crankcase 14. On the cylinder side opposite the mixture intake 18 and the exhaust port 19, a branch 20*a* of an air passage 20, not illustrated in FIG. 2, opens into the cylinder 13. The branch 20*a* of the air passage 20 opens by means of an air intake 21 into the cylinder 13.

In the area of the bottom dead center of the piston 15 illustrated in FIG. 2, the crankcase 14 is connected to the combustion chamber 49 by a total of four transfer passages 24, 25. In FIG. 2, two of the transfer passages 24, 25 are illustrated. The transfer passages 24 open by means of transfer ports 26 into the combustion chamber 49 and the transfer passages 25 by means of transfer ports 27.

In FIG. 3, the arrangement of four transfer passages 24, 25 at the cylinder is illustrated. As shown in FIG. 3, the cylinder 13 has a center plane 37 dividing the exhaust port 19 centrally; the cylinder axis 22 is located in the center plane 37. One branch 20*a*, 20*b* of the air channel 20 extends on each side of the center plane 37, respectively. Each branch 20*a*, 20*b* of the air passage 20 opens with an air intake 21 into the cylinder bore. The piston 15 has a piston recess 28 on each side of the center plane 37. The two piston recesses 28 are symmetric to the center plane 37. Each piston recess 28 connects a branch 20*a*, 20*b* of the air passage 20 to the transfer ports 26 and 27 of two transfer passages 24 and 25 that are arranged on one side of the center plane 37, respectively.

The two-stroke engine 12 has a transverse plane 30 that extends perpendicularly to the center plane 37; the longitudinal cylinder axis 22 is located in the transverse plane 30. On one side of the transverse plane 30 the exhaust port 19 is arranged. The main flow direction 48 in the exhaust port 19 extends parallel to the center plane 37 and perpendicularly to the transverse plane 30 in the section illustration shown in FIG. 3. The two branches 20*a*, 20*b* of the air passage 20 extend on the side of the transverse plane 30 opposite the exhaust port 19. As shown in FIG. 2, the mixture intake 18 and the exhaust port 19 are arranged on the side of the transverse plane 30 opposite the air passage 20.

Figure 4:
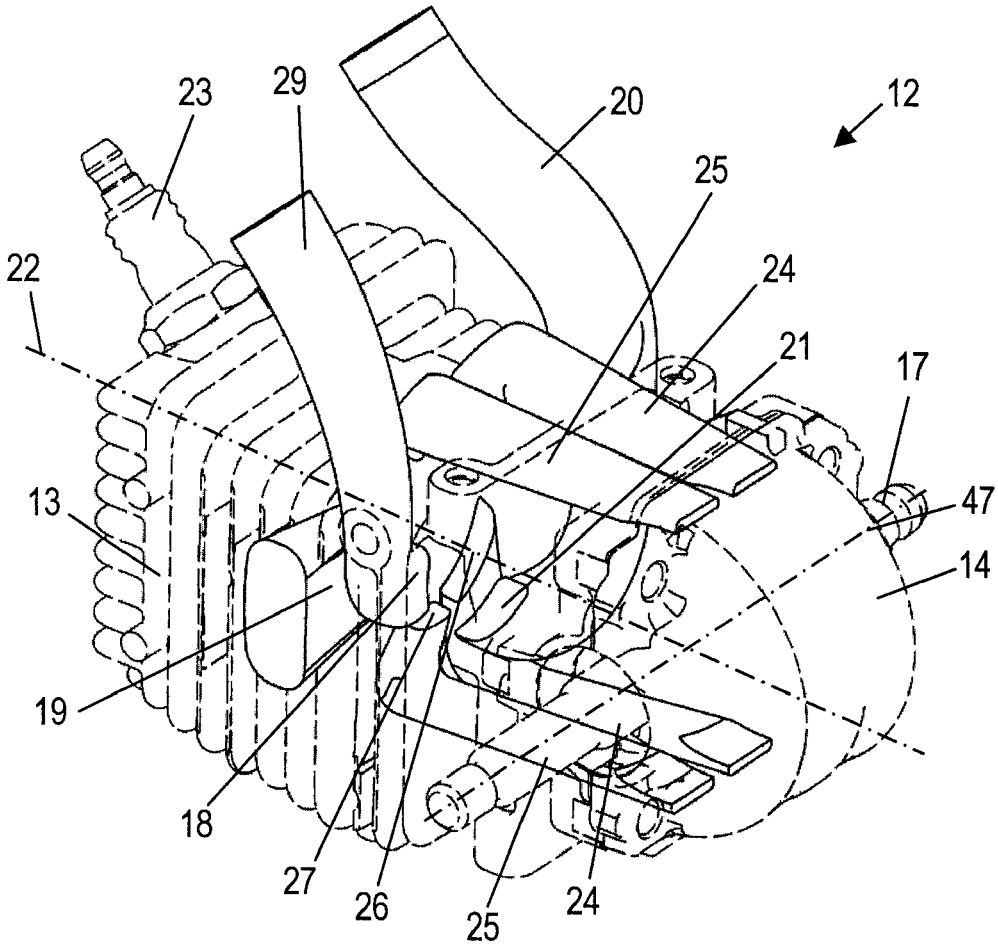
FIG. 4 is a schematic perspective illustration of the two-stroke engine of the power tool.

In FIG. 4, the two-stroke engine 12 is illustrated in a perspective, schematic view. The passages of the two-stroke engine 12 are illustrated in solid lines and the components of the two-stroke engine 12 are shown in dashed lines. As shown in FIG. 4, one transfer passage 24 and one transfer passage 25 each extend on either side of the center plane 37 (FIG. 3) that is determined by the longitudinal cylinder axis 22 and the axis of rotation 47 of the crankcase 17. The two-stroke engine 12 has a mixture passage 29 that opens at the mixture intake 18 into the cylinder 13. The mixture passage 29 extends on the side of the transverse pane 30 (FIG. 3) where the exhaust port 19 is arranged also. On the opposite side of the transverse plane 30, the air channel 20 is positioned.

Figure 5:
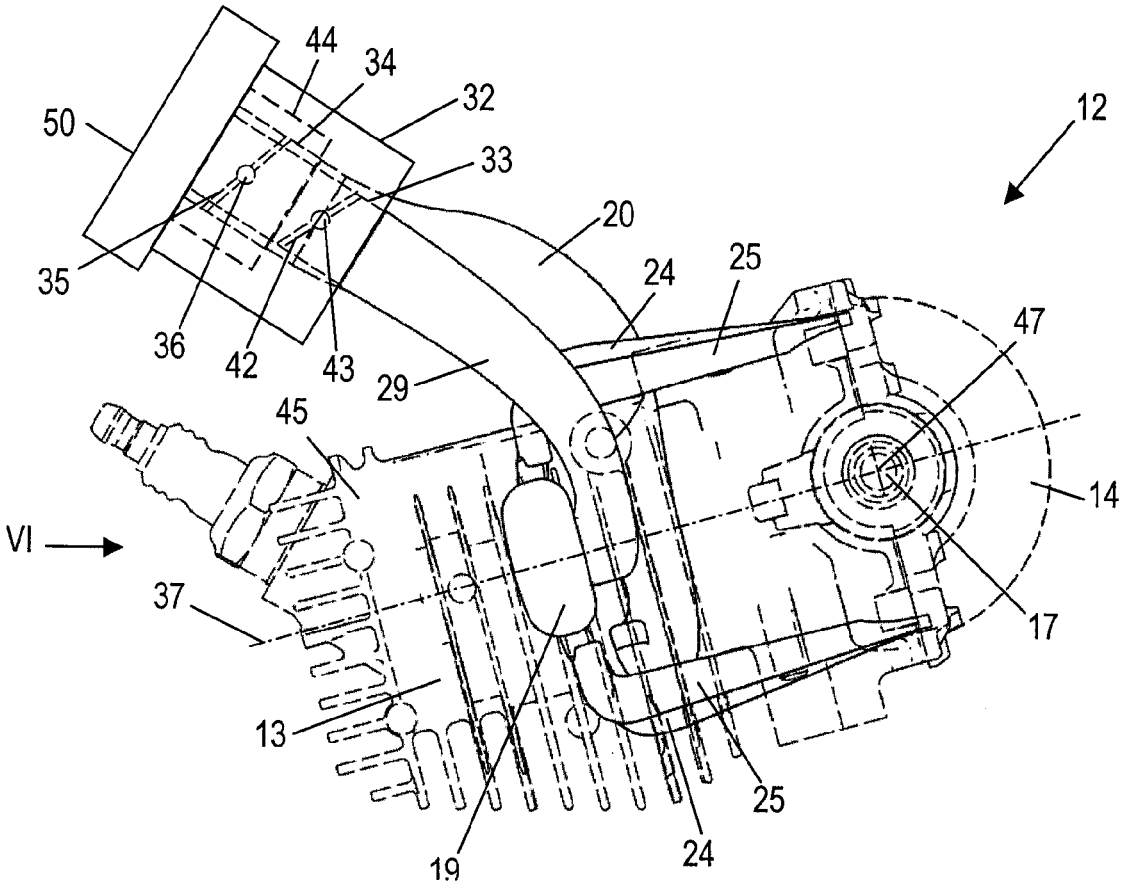
FIG. 5 is a schematic side view of the two-stroke engine of FIG. 4 showing the carburetor arranged thereat.

As shown in FIG. 5, the two-stroke engine 12 has a carburetor 32 in which a mixture passage section 33 of the mixture passage 29 is provided. In the mixture passage section 33 a throttle element in the form of a throttle 42 is arranged. The throttle 42 is supported pivotably by means of a throttle shaft 43 in the mixture passage section 33. Upstream of the throttle 42 a choke element can be provided.

An air passage section 34 is formed in an air passage component 44. In the air passage section 34 a choke 35 is pivotably supported by means of choke shaft 36. The position of the choke 35 is coupled by means of a coupling mechanism (not illustrated) to the position of the throttle 42 so that at least over a portion of the movement of the throttle 42 the choke 35 carries out a corresponding movement. The mixture passage 29 and the air passage 20 are connected to the clean side of an air filter 50. The carburetor 32 and the air passage component 44 are arranged at the level of the cylinder head 45 of the cylinder 13, i.e., relative to the cylinder head 45 they are arranged perpendicularly to the longitudinal cylinder axis 22.

Figure 6:
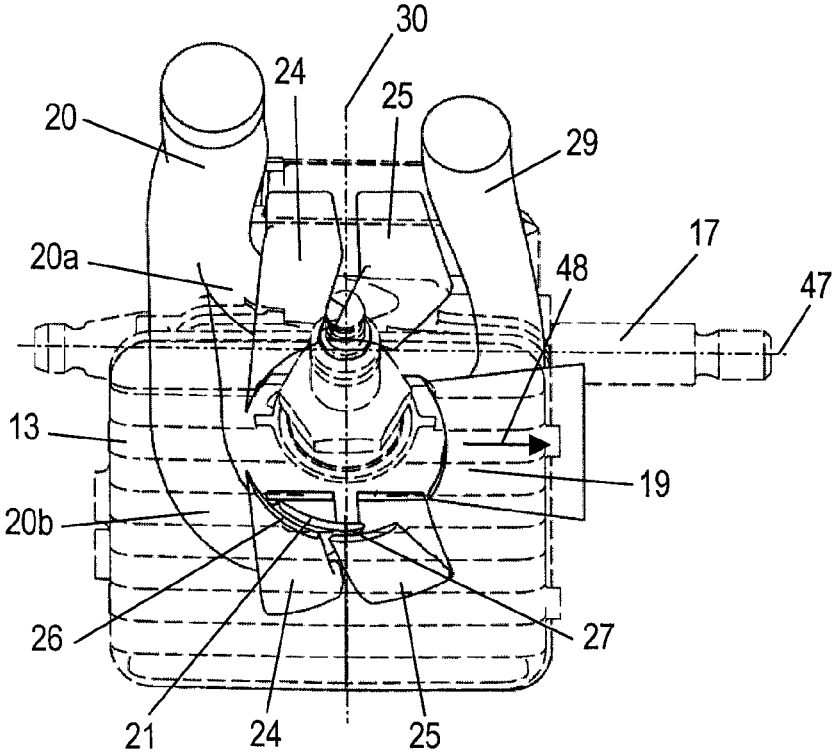
FIG. 6 is view of the two-stroke engine of FIG. 5 in the direction of arrow VI.

As shown in the view of FIG. 6, the mixture passage 29 is arranged completely on the side of the transverse plane 30 where the exhaust port 19 extends away from the combustion chamber 49. On the opposite side of the transverse plane 30, the air passage 20 is provided. The air passage 20 is divided adjacent to the cylinder 13 into the two branches 20*a* and 20*b*. The branch 20*a* opens into the cylinder 13 at air intake 21 on the side of the center plane 37 where the carburetor 32 is arranged also. The branch 20*b* of the air passage 20 is guided circumferentially about the cylinder and opens at the opposite side of the center plane 37 at air intake 21 into the cylinder 13. Each air intake 21 is arranged on the side of the transfer ports 26 and 27 that is facing the crankcase 14.

Figure 7:
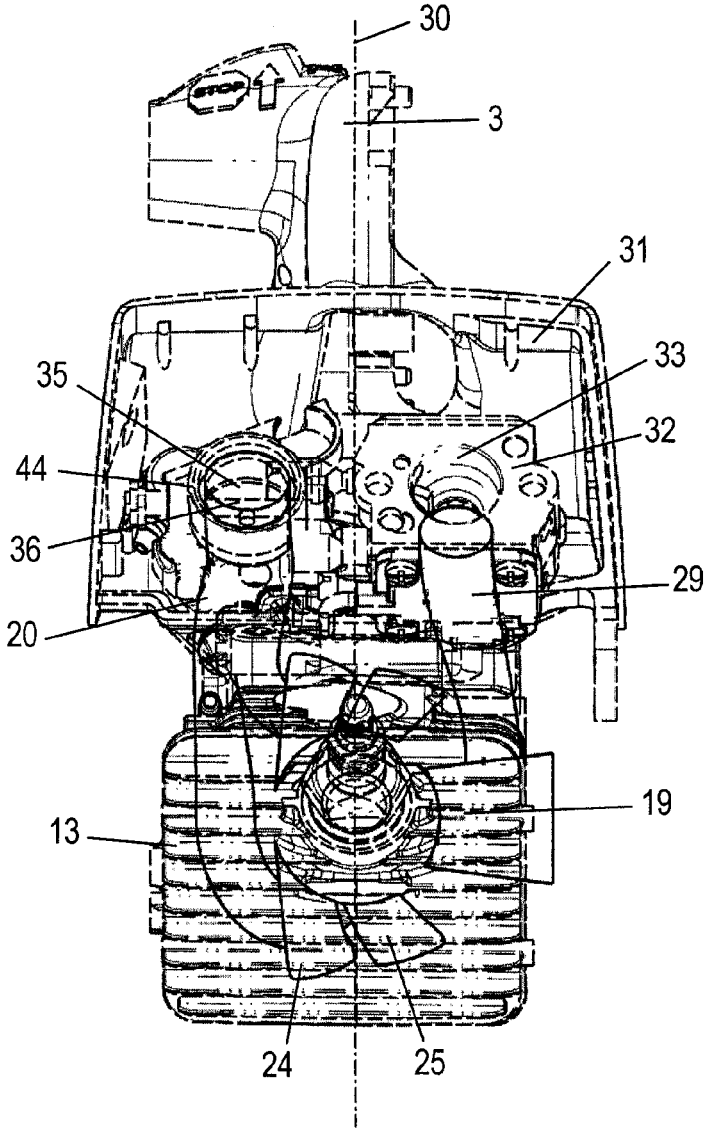
FIG. 7 is a schematic illustration of the two-stroke engine with grip housing arranged thereat in a view in the direction of arrow VII of FIG. 1.

In FIG. 7, the mounted position of the carburetor 32 and of the air passage component 44 in the grip housing 31 is shown. The air passage component 44 is secured on the carburetor 32. As shown in FIG. 7, the carburetor 32 as well as the air passage component 44 are arranged completely within the grip housing 31. The carburetor 32 and the air passage component 44 are arranged on the side of the cylinder 13 facing the top handle 3. Carburetor 32 and air channel component 44 are arranged on opposite sides of the transverse plane 30. As shown in FIG. 7, when placing the motor chainsaw 1 onto the ground with the top handle 3 facing upwardly, the exhaust port 19 is positioned approximately parallel to the ground. With this orientation of the exhaust port 19, it is prevented that exhaust gases exiting from the exhaust port 19 can set on fire material lying on the ground, for example, leaves.

Figure 8:
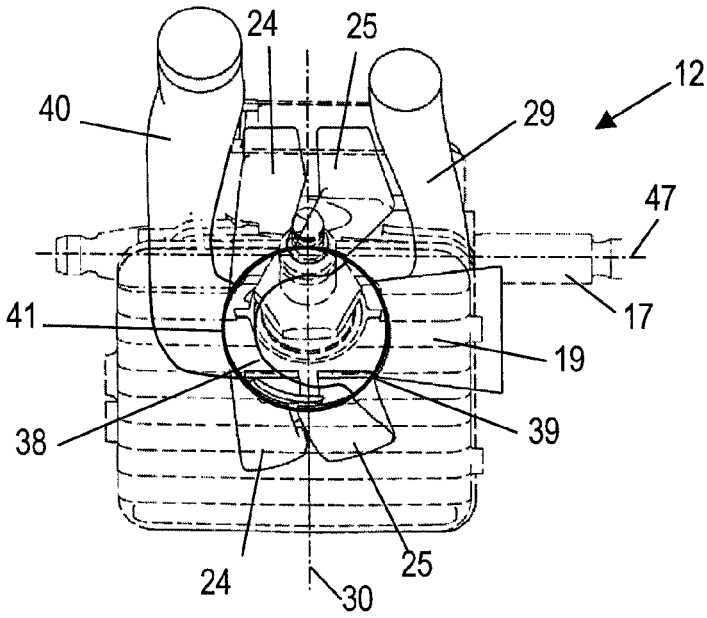
FIG. 8 is a schematic side view of another embodiment of the two-stroke engine.

FIG. 8 shows another embodiment of a two-stroke engine 12. The two-stroke engine 12 has a piston 39 that has a single piston recess 38. On the side of the transverse plane 30 where the exhaust port 19 is arranged, a mixture passage 29 of the two-stroke engine 12 is provided. On the opposite side of the transverse plane 30, an air passage 40 is provided that opens by means of air intake 41 into the cylinder 13. The air intake 41 is arranged opposite the exhaust port 19 and opposite the mixture intake 18 (not shown in FIG. 8). Viewed in the circumferential direction, the air intake 41 opens approximately centrally into the piston recess 38. By means of the piston recess 38, the air passage 40 is connected to the transfer ports of the transfer passages 24, 25. The air intake 41 is arranged above one end of the crankshaft 17; the exhaust port 19 and the mixture intake 18 are arranged above the opposed end of the crankshaft 17. In comparison to known arrangements, the crankshaft 17 is thus rotated by 90 degrees about the longitudinal cylinder axis 22.

The specification incorporates by reference the entire disclosure of German priority document 10 2006 001 570.3 having a filing date of Jan. 12, 2006.

While specific embodiments of the invention have been shown and described in detail to illustrate the inventive principles, it will be understood that the invention may be embodied otherwise without departing from such principles.

What is claimed is:

1. A power tool comprising:

a working tool;

a two-stroke engine driving the working tool;

the two-stroke engine comprising a cylinder and a piston reciprocating within the cylinder in a direction of a longitudinal cylinder axis, wherein the cylinder has a combustion chamber delimited by the piston;

the two-stroke engine comprising a crankcase and a crankshaft rotatably supported in the crankcase about an axis of rotation, wherein the piston drives with a connecting rod the crankshaft;

the two-stroke engine having one or more transfer passages connecting the crankcase to the combustion chamber in at least one position of the piston, wherein the one or more transfer passages each have a transfer port opening into the combustion chamber;

the two-stroke engine comprising a mixture passage with a mixture intake for supplying a fuel/air mixture to the crankcase;

the two-stroke engine having an air passage for supplying combustion air;

wherein the mixture passage and the air passage are connected to a clean side of an air filter of the two-stroke engine;

wherein the combustion chamber has an exhaust port provided within the cylinder;

wherein the two-stroke engine has a transverse plane dividing the cylinder in a direction of the longitudinal cylinder axis;

wherein the exhaust port is arranged on one side of the transverse plane; and wherein the air passage and the mixture passage are arranged on opposite sides of the transverse plane;

a power tool housing and a top handle that extends across a top side of the power tool housing, wherein the two-stroke engine is arranged in the power tool housing such that the transverse plane of the two-stroke engine is parallel to a longitudinal axis of the top handle.

2. The power tool according to claim 1, wherein the two-stroke engine comprises an air filter, wherein the air passage and the mixture passage are connected to a clean side of the air filter.

3. The power tool according to claim 1, wherein the axis of rotation of the crankshaft is perpendicular to the transverse plane.

4. The power tool according to claim 1, wherein the mixture passage is arranged on said one side of the transverse plane where the exhaust port is arranged.

5. The power tool according to claim 4, wherein the mixture intake opens into the crankcase adjacent to the exhaust port at a side of the exhaust port facing the crank case, wherein the mixture intake is piston-controlled.

6. The power tool according to claim 1, wherein the two-stroke engine has a center plane dividing the exhaust port, wherein on either side of the center plane at least one of the one or more transfer passages is arranged.

7. The power tool according to claim 6, wherein a main flow direction of the exhaust port is parallel to the center plane.

8. The power tool according to claim 6, wherein the center plane is perpendicular to the transverse plane and wherein the longitudinal cylinder axis and the axis of rotation of the crankshaft are located within the center plane.

9. The power tool according to claim 6, wherein the piston has one or more piston recesses, and wherein the air passage is connected through the one or more piston recesses in at least one position of the piston to at least one of the transfer ports of the one or more transfer passages.

10. The power tool according to claim 9, wherein the air passage is divided into two branches upstream of an air intake at the cylinder, wherein the piston has two of said one or more piston recesses arranged on opposite sides of the center plane, wherein each one of said two branches opens into the cylinder in the area of one of said two piston recesses.

11. The power tool according to claim 6, wherein the piston has a single piston recess, wherein the air passage is connected through the single piston recess in at least one position of the piston to the transfer ports of all of the transfer passages, wherein the air passage has a single air intake that opens into the cylinder in a central area of the single piston recess.

12. The power tool according to claim 1, wherein the two-stroke engine has a carburetor in which a mixture passage section is provided and in which a throttle element is pivotably supported, wherein the two-stroke engine further comprises an air passage component in which an air passage section is provided and in which a choke is pivotably supported, wherein the air passage component is secured to the carburetor.

13. The power tool according to claim 12, wherein the carburetor and the air passage component are arranged at the level of a cylinder head of the cylinder.

14. The power tool according to claim 1, wherein the carburetor is arranged on a side of the cylinder that is facing the top handle.

15. The power tool according to claim 1, wherein the two-stroke engine is arranged substantially horizontally in the power tool housing.

* * * * *